US005787626A

United States Patent [19]

Bingham et al.

[11] Patent Number: 5,787,626

[45] Date of Patent: Aug. 4, 1998

[54] FUNERAL PRODUCT DISPLAY CASE

[75] Inventors: Curt A. Bingham, Batesville, Ind.; Richard J. Boudreau, Sterling, Va.; Paul A. Holzman, Cincinnati, Ohio; Dale F. Meyer, Batesville, Ind.

[73] Assignee: Batesville Casket Company, Inc., Batesville, Ind.

[21] Appl. No.: 634,593

[22] Filed: Apr. 30, 1996

[51] Int. Cl.[6] ..... G09F 1/12; A47B 67/02

[52] U.S. Cl. ..... 40/735; 40/730; 40/757; 40/773; 40/605; 312/245; 312/234

[58] Field of Search ..... 40/605, 611, 657, 40/715, 729, 730, 735, 757, 768, 773; 312/234, 245, 248, 321.5, 223.5

[56] References Cited

U.S. PATENT DOCUMENTS

| | | | |
|---|---|---|---|
| 153,283 | 7/1874 | Shatto | 40/735 X |
| 1,102,145 | 6/1914 | Davis | 40/611 |
| 3,680,238 | 8/1972 | Arnold | 40/605 X |
| 4,214,392 | 7/1980 | Virsen | 40/605 |
| 4,271,622 | 6/1981 | Tippmann et al. | 40/611 X |
| 4,899,473 | 2/1990 | Wiener | 40/735 X |
| 4,947,565 | 8/1990 | Shadwell | 40/768 X |

FOREIGN PATENT DOCUMENTS

| | | | |
|---|---|---|---|
| 639661 | 6/1928 | France | 40/611 |
| 283093 | 9/1962 | Netherlands | 312/245 |

OTHER PUBLICATIONS

Nevers Industries, Inc., 14125 21st Av. N., Minneapolis, MN 55447, Visual Presentation Boards Brochure (12 8.5"× 11"pages).

Elder Davis, Inc., 1010 Industries Road, Richmond, IN 47375–0268 C*O*P*E Cremation Products "The Illuminator" Brochure (4 8.5"×11"pages).

McMaster–Carr Supply Company, P.O. Box 4355, Chicago, IL 60680–4355, Catalog 102, "Threaded Inserts For Wood" and Sleeve Type Connecting Screws (3 pages).

*Primary Examiner*—Brian K. Green

*Attorney, Agent, or Firm*—Wood, Herron & Evans

[57] ABSTRACT

A funeral product display case for displaying facsimiles of such funeral products as burial caskets, cremation caskets, cremation containers, cremation urns and the like in a funeral home display area for purposes of offering for sale the funeral products to customers of the funeral home comprises a cabinet mountable to a wall of the funeral home display area and having interconnected back, top, bottom and side walls. A door is pivoted to a side edge of the cabinet and is movable to and between an open position wherein the contents of the cabinet are viewable and a closed position wherein the contents of the cabinet are concealed. A first sheet-like member is removably received against the back wall of the cabinet and includes a decorative front, a back and a plurality of apertures therein. A plurality of facsimiles of funeral home products such as burial caskets, cremation caskets, cremation containers, cremation urns and the like are removably secured to the back of the first sheet-like member, and are positioned on the first sheet-like member back so as to be viewable through the apertures when the door is in the open position. A second sheet-like member which is transparent removably overlies the first sheet-like member.

14 Claims, 2 Drawing Sheets

FUNERAL PRODUCT DISPLAY CASE

FIELD OF THE INVENTION

This invention relates generally to funeral products such as burial caskets, cremation caskets, cremation containers, cremation urns and the like, and more particularly to a display case for displaying facsimiles of such funeral products for purposes of offering for sale those products to customers of a funeral home.

BACKGROUND OF THE INVENTION

Currently, funeral products such as burial caskets, cremation caskets, cremation containers and cremation urns are presented to customers of a funeral home by a funeral director in one of three ways. First, a funeral home may have what is known as a selection room. There numerous products are displayed for selection by the family of a deceased. The products are generally arranged in an attractive setting and specialized display stands, alcoves, casket racks and the like may be utilized. The advantage of a selection room is that the customer is able to actually see and touch the specific product he/she is selecting. Disadvantages of the selection room are that a large amount of square footage must be provided to accommodate the products, selection is limited to stock on hand, and grieving family members may find the experience of visiting the selection room unpleasant.

Second, a funeral director may employ the use of a product and service catalogue or notebook, sometimes known as an arranger reference guide, which includes color photographs and textual description of the various products and services offered. Generally, the funeral director will sit down with a customer at a conference table and in an arranging conference page through the guide while explaining the features and advantages of the various products to the customers. The advantages of such a presentation are that a large selection room is not required, selection is not limited to stock on hand and customers are not required to visit a selection room. Disadvantages of this method are that it is somewhat difficult for a customer to compare the various products side-by-side since generally each guide page is limited to a single product, and the customer may be hesitant to vary the pace of the presentation to fully consider each product.

A third method, and one proposed solution to solving these problems of funeral product display, is to employ the use of transparencies of the funeral products which are slid down into a back lighted wall mounted display from its top. The advantages of this type of display are that a selection room and stock are not required, and multiple products may be viewed simultaneously on a display at the leisure and pace of the customer. Disadvantages of this system are cost in that the display is expensive, and the transparencies are expensive as well running on the order of about thirty dollars per transparency, up to about one hundred thirty dollars per transparency, depending on the size of the transparency and the product illustrated thereon, and interchangeability of the transparencies is somewhat cumbersome, particularly if the display is mounted relatively high on the wall positioning the top of the display near the ceiling.

It is therefore a main objective of the present invention to provide an improved means of displaying funeral products such as burial caskets, cremation caskets, cremation containers and cremation urns and other funeral service products to customers of the funeral home which does not have the attendant disadvantages of prior art methods discussed above.

SUMMARY OF THE INVENTION

In accordance with the stated objective, the present invention is a funeral product display case for displaying facsimiles of such funeral products as burial caskets, cremation caskets, cremation containers, cremation urns and the like in a funeral home display area for purposes of offering for sale the funeral products to customers of the funeral home. The display case comprises a cabinet mountable to a wall of the funeral home display area and having interconnected back, top, bottom and side walls. A door is pivoted to a side edge of the cabinet and is movable to and between an open position wherein the contents of the cabinet are viewable and a closed position wherein the contents of the cabinet are concealed. A first sheet-like member is removably received against the back wall of the cabinet and includes a decorative front, a back and a plurality of apertures therein. A plurality of facsimiles of funeral home products such as burial caskets, cremation caskets, cremation containers, cremation urns and the like are removably secured to the back of the first sheet-like member, and are positioned on the first sheet-like member back so as to be viewable through the apertures when the door is in the open position. A second sheet-like member which is transparent removably overlies the first sheet-like member.

Cards containing textual material relating to the funeral home products may additionally be removably secured to the back of the first sheet-like member, the cards being positioned on the first sheet-like member back so as to be viewable through the apertures when the door is in the open position. The facsimiles of funeral home products are preferably lithographs. The first sheet-like member is preferably mat board and the second sheet-like member is preferably plexiglass. The display case preferably further comprises means for removably securing the facsimiles to the back of the first sheet-like member, as well as means for removably securing the first and second sheet-like members to the cabinet back wall. The facsimile removable securing means preferably comprises removable/reusable tape, and the sheet-like member removable securing means preferably comprises a threaded nut countersunk into the cabinet back wall at each corner thereof and a threaded thumb screw passing through clearance holes in the sheet-like members and threaded into the nut.

The door of the display case of the present invention preferably is of the same construction as the cabinet and has interconnected back, top, bottom and side walls. In this way a third sheet-like member, similar to the first sheet-like member discussed above, is removably received against the back wall of the door, funeral home product facsimiles are removably secured to the back of this third sheet-like member and a fourth sheet-like member, similar to the second sheet-like member discussed above, removably overlies the third sheet-like member. In this way the display case of the present invention provides a dual width display or otherwise two display panels by utilizing the door for display purposes in addition to the cabinet, unlike prior wall mounted funeral product displays.

The present invention also provides a pair of funeral product display cases of the above construction positioned in side-by-side relation along abutting side edges. In this configuration, the door of each display case is pivoted to the side edge of the cabinet remote from a respective display case abutting edge. In this way, four display panels are thus provided when the doors of both cabinets are opened. Preferably means are provided to secure the abutting side edges of the display cases together. The display case abutting edge securing means preferably comprises an internally threaded bolt passing through a clearance hole in a side wall of one of the cabinets and an externally threaded bolt passing through a clearance hole in an adjacent, abutting side wall of the other cabinet and threaded into the internally threaded bolt.

The display case of the present invention may further comprise goose-neck type lamps secured to the top of the display case, the heads of which lamps are directable toward the funeral product facsimiles to illuminate same.

The present invention also provides a funeral home display area comprising a display wall and the above described funeral product display case mounted on the wall, as well as a method of offering for sale funeral products to customers of a funeral home by providing the above described funeral product display case, mounting the display case on a wall of the funeral home display area and opening the door of the display case to display its contents.

One advantage of the present invention is that a funeral home is not required to have a selection room to display funeral products to customers, and as such does not have the attendant disadvantages of keeping stock on hand, the customer's selection being limited to that stock on hand and the customer having to endure the unpleasant experience of visiting the selection room.

Another advantage of the present invention is that a customer may readily compare various products since a number of such products are displayable and thus viewable simultaneously.

Yet another advantage of the present invention is that a customer may peruse the various products displayed at his/her own pace rather than at the pace of a funeral director at a conventional arrangement conference.

Still another advantage of the present invention is that it is less expensive than prior transparency display units, and the lithographs utilized in the display of the present invention, at approximately 16 cents each, are much less expensive than the transparencies utilized in the prior transparency displays, at approximately 30 to 130 dollars each.

A further advantage of the present invention is that the display is readily changed out with other products via the use of the removable/reusable tape attaching the lithographs to the mat board and the thumb screws attaching the mat board and plexiglass to the back of the cabinet and/or door.

Yet a further advantage of the present invention is that, unlike prior transparency display units, both the cabinet and the door are utilizable to provide two display panels per display case.

Still a further advantage of the present invention is that a pair of display cases may be abutted to provide a total of four display panels when utilizing the cabinet and door of each display case for display purposes.

These and other objects and advantages of the present invention will become more readily apparent during the following detailed description taken in conjunction with the drawings herein, in which:

DETAILED DESCRIPTION OF THE INVENTION

Figure 1:
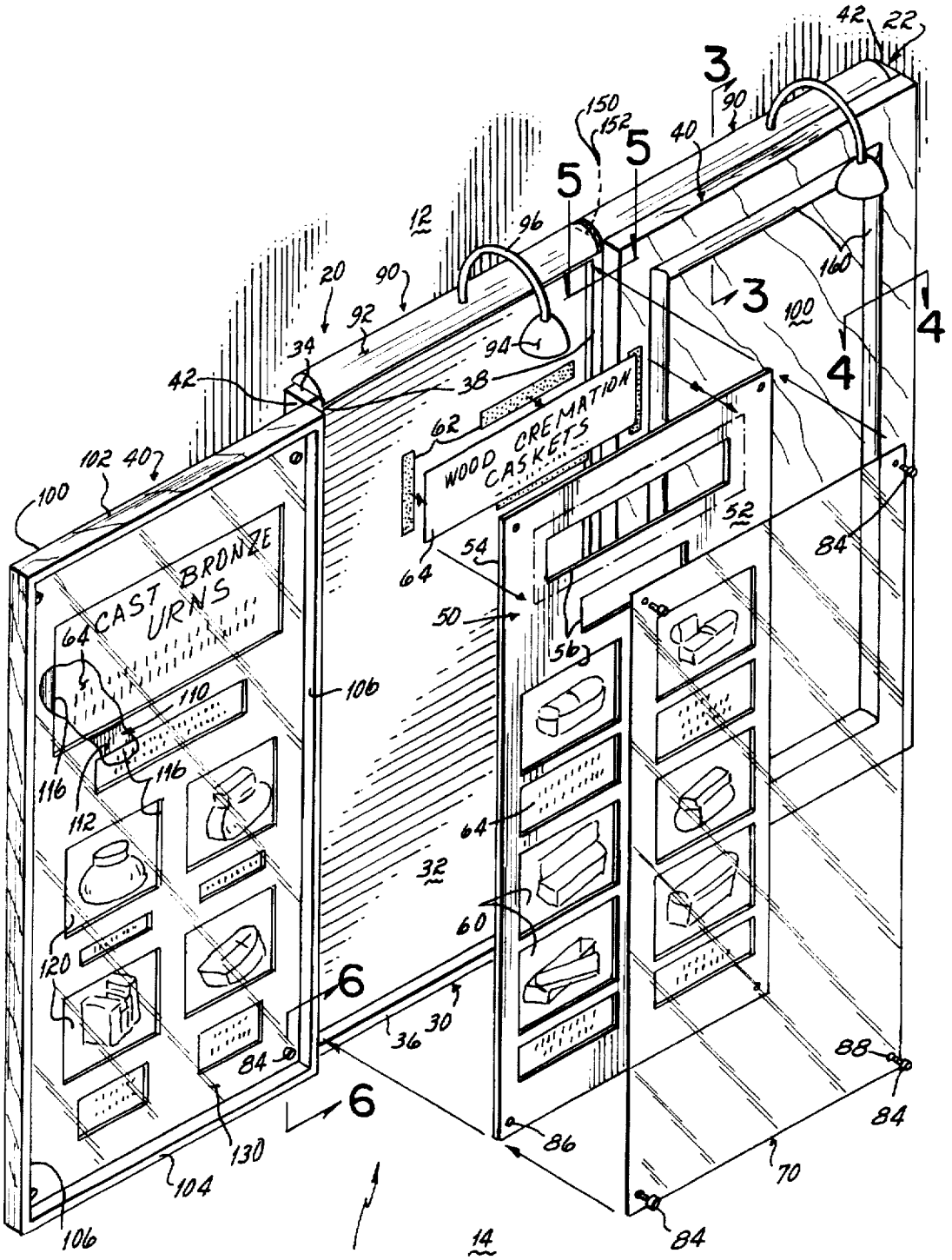
FIG. 1 is a perspective view of the funeral product display case of the present invention.

Referring first to FIG. 1, there is illustrated a display 10 according to the principles of the present invention. Display 10 is mounted on a wall 12 in a display area 14 of the funeral home.

Figure 2:
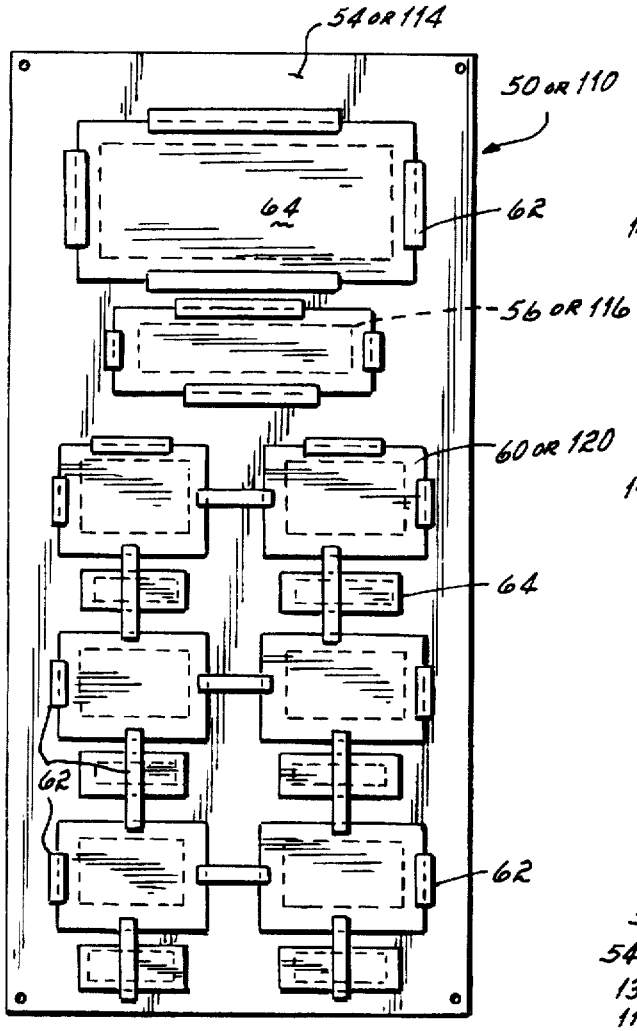
FIG. 2 is a rear plan view of a typical mat board with lithographs removably attached thereto for use in the display case of FIG. 1.
Figure 4:
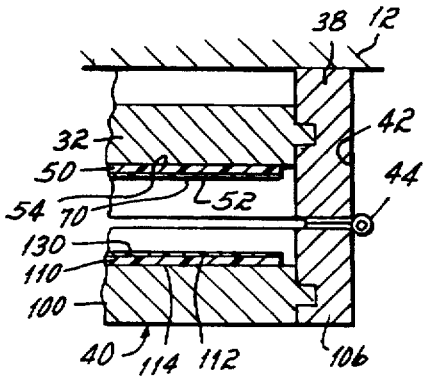
FIG. 4 is a view taken along line 4—4 of FIG. 1.

The display 10 is comprised of two display cases 20 and 22, which are generally of the same construction except for minor differences which will be discussed below. The display cases 20 and 22 are preferably fabricated of decorative wood of the type normally found in fine furniture, for example oak, mahogany, cherry, walnut and the like. Each display case 20 and 22 comprises a cabinet 30 mountable to the wall 12 of the funeral home display area 14 and including interconnected back 32, top 34, bottom 36 and side 38 walls. A door 40 is pivoted to a side edge 42 of the cabinet 30 as by hinges 44 (FIG. 4). The door is movable to and between an open position (display case 20) wherein the contents of the cabinet are viewable and a closed position (display case 22) wherein the contents of the cabinet are concealed. A first sheet-like member 50 is removably received against the back wall 32 of the cabinet 30. The sheet-like member 50 includes a decorative front 52, a back 54 and a plurality of apertures 56 therein. The sheet-like member 50 is preferably mat board, for example that used in matting around a picture to be framed. The decorative front 52 may be, for example, a desirable, attractive color. A plurality of facsimiles 60 of funeral home products, such as burial caskets, cremation caskets, cremation containers, cremation urns and the like are removably secured to the back 54 of the first sheet-like member 50. The facsimiles 60 are preferably lithographs of the funeral products. The facsimiles 60 are positioned on the first sheet-like member back 54 so as to be viewable through the apertures 56 when the door 40 is in the open position. As shown in FIGS. 1 and 2, the facsimiles 60 are secured to the back 54 of the sheet-like member 50 with the use of Scotchmark™ 256 pressure sensitive white printable paper tape 62 manufactured by 3M of St. Paul, Minn. which is both removable and reusable. In addition, cards 64 containing printed textual material thereon describing the funeral home products may similarly be positioned on the back of the sheet 54 so as to appear through the apertures 56 and secured there via the tape 62 thus providing textual description of the various products and their features and advantages. A second sheet-like member 70, preferably transparent plexiglass, removably overlies the first sheet-like member 52.

Figure 6:
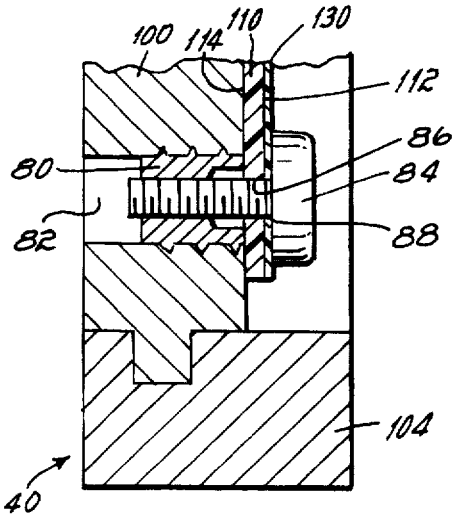
FIG. 6 is a view taken along line 6—6 of FIG. 1.

As shown in FIG. 1 and more particularly in FIG. 6, an internally and externally threaded nut 80 is countersunk into the cabinet back 32 at each corner in hole 82. A threaded thumb screw 84 passes through clearance holes 86 and 88 in the first and second sheet-like members 50 and 70, respectively and is threaded into the nut 80. Threaded nut 80 is preferably supplied by McMaster-Carr Supply Company of Chicago, Ill. as part number 92105A675. Thus, with the thumb screws 84 and removable/reusable tape 62, the funeral product facsimiles 60 and textual descriptions 64 may be quickly and easily changed out to display other funeral products with different features and advantages.

Referring back to FIG. 1, the display case 20 may be outfitted with a lamp 90 having a base 92 secured to the top of the cabinet 30 including a lamp head 94 connected to a gooseneck 96 itself attached to the base 92, such that the lamp head 94 is directable toward the funeral product facsimiles 60 mounted in the cabinet 30 to illuminate the same.

The door 40 of the display case 20 preferably is of the same general construction as the cabinet 30 and includes a back 100, top 102, bottom 104 and side 106 walls. A third sheet-like member 110 generally of the same construction as the first sheet-like member 50 is received against the back wall 100 of the door 40 and likewise includes a decorative front 112, a back 114 and a plurality of apertures 116 therein. Lithographs 120 of funeral home products are similarly removably secured to the back 114 of the third sheet-like member 110 via the use of the tape 62 so as to be viewable through the apertures 116 when the door 40 is open. Textual description cards 64 may also be included. A fourth sheet-like member 130, of the same construction as the first sheet-like member 50, removably overlies the third sheet-like member 110, and the two sheet-like members 110 and 130 are secured to the back wall 100 of the door 40 via the same type of threaded nuts 80 and thumb screws 84 in the same corner locations.

As shown on display case 22, decorative molding 160 may be secured to the display case doors 40. Though not shown, the doors 40 and cabinets 30 of the display cases 20 and 22 may include co-operating magnets to hold the doors in their closed positions. In addition, a finger groove (not shown) may be routed into the upper surface of top wall 102 and lower surface of bottom wall 104 near the side edge remote from the hinge edge to aid in opening the door 40.

Figure 3:
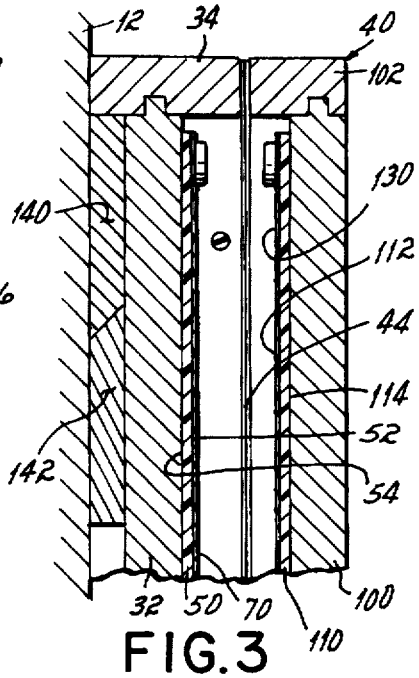
FIG. 3 is a view taken along line 3—3 of FIG. 1.

As shown in FIG. 3, the cabinet 30 includes a cleat 140 secured to its back in an upper position. A mating cleat 142 is secured to the wall 12 for hanging the display 30 via the cleat 140 therefrom.

Referring back to FIG. 1, a pair of display cases 20 and 22 may be positioned in side-by-side relation as shown along abutting side edges 150 and 152 to provide four display panels when utilizing both the cabinet and door of each display case 20 and 22. The door of each display case is pivoted to the side edge of the cabinet remote from its respective display case abutting side edge 150 and 152.

Figure 5:
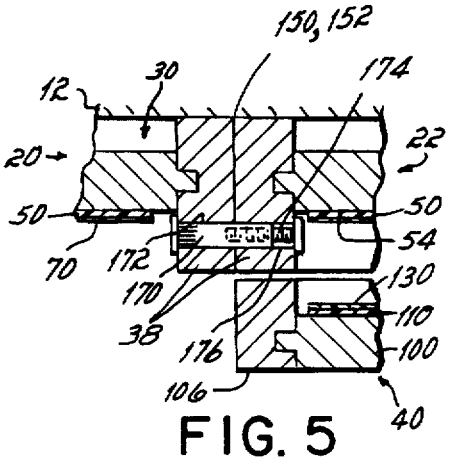
FIG. 5 is a view taken along line 5—5 of FIG. 1.

As best seen in FIG. 5, an internally threaded bolt (or elongated, headed nut) 170 passes through a clearance hole 172 in a side wall 38 of one of the pair of cabinets and an externally threaded bolt 174 passes through a clearance hole 176 in an adjacent, abutting side wall 38 of the other of the pair of cabinets and is threaded into the internally threaded bolt 170 to secure the two display cases 20 and 22 together. Bolts 170 and 174 are preferably supplied by Baer Supply Company of Vernon Hills, Ill. as part number KD-565NP-35-C or KD-565NP-35. One or more such bolts 170 and 174 may be employed as desired to secure the display cases 20 and 22 together along abutting edges 150 and 152.

In use of the present invention, one or more display cases constructed as described herein are mounted on the wall 12 of a funeral home display area 14. The doors to the display cases are kept in their closed position so that the funeral director can first provide the customer with a price sheet of the products to be displayed before the products are actually displayed to the customer, as required by FTC regulations. Then the doors to the display cases are opened to display the contents of the display cases to the funeral home customer, namely the various funeral products such as burial caskets, cremation caskets, cremation containers, cremation urns and the like and the various textual material relating to same. The customer may then peruse the display at his/her leisure en route to making a selection.

Those skilled in the art will readily recognize numerous adaptations and modifications which can be made to the present invention which will result in an improved funeral product display case and method, yet all of which will fall within the spirit and scope of the present invention as defined in the following claims. For example, the door of the display case could be eliminated in which case the funeral director would supply the customer with the product price sheet outside the presence of the display case per the FTC regulations, for example outside of a closed conference room containing the door-less display case. Then the funeral director would escort the customer into the conference room whereat he/she would proceed to peruse the contents of the display case as described above. Accordingly, the invention is to be limited only by the scope of the following claims and their equivalents.

What is claimed is:

1. A funeral product display case for displaying facsimiles of funeral products in a funeral home display area for purposes of offering for sale the funeral products to customers of the funeral home, said display case comprising:

a cabinet mountable to a wall of the funeral home display area and having interconnected back, top, bottom and side walls;

a door pivoted to a side edge of said cabinet and movable to and between an open position wherein the contents of said cabinet are viewable and a closed position wherein the contents of said cabinet are concealed;

a first sheet-like member removably received against said back wall of said cabinet and including a decorative front, a back and a plurality of apertures therein;

a plurality of facsimiles of funeral products such as burial caskets, cremation caskets, cremation containers and cremation urns removably secured to said back of said first sheet-like member, said facsimiles being positioned on said first sheet-like member back so as to be viewable through said apertures when said door is in the open position; and a second sheet-like member which is transparent and which removably overlies said first sheet-like member;

wherein said door comprises interconnected back, top, bottom and side walls, and wherein said display case further comprises:

a third sheet-like member removably received against said back wall of said door and including a decorative front, a back and a plurality of apertures therein;

a plurality of facsimiles of funeral products such as burial caskets, cremation caskets, cremation containers and cremation urns removably secured to said back of said third sheet-like member, said facsimiles being positioned on said third sheet-like member back so as to be viewable through said apertures when said door is in the open position; and a fourth sheet-like member which is transparent and which removably overlies said third sheet-like member.

2. The funeral product display case of claim 1 further comprising:

cards containing textual material relating to the funeral home products removably secured to said back of said first sheet-like member, said cards being positioned on said first sheet-like member back so as to be viewable through said apertures when said door is in the open position.

3. The funeral product display case of claim 1 wherein said facsimiles of funeral home products are lithographs.

4. The funeral product display case of claim 1 wherein said first sheet-like member is mat board.

5. The funeral product display case of claim 1 wherein said second sheet-like member is plexiglass.

6. The funeral product display case of claim 1 further comprising:

means for removably securing said facsimiles to said backs of said first and third sheet-like members.

7. The funeral product display case of claim 6 wherein said facsimile removable securing means comprises removable/reusable tape.

8. The funeral product display case of claim 1 further comprising:

means for removably securing said first and second sheet-like members to said cabinet back and for removably securing said third and fourth sheet-like members to said door back.

9. The funeral product display case of claim 8 wherein said sheet-like member removable securing means comprises a threaded nut countersunk into said cabinet back wall and said door back wall at each corner thereof and a threaded thumb screw passing through clearance holes in said sheet-like members and threaded into said nut.

10. A method of offering for sale funeral products to customers of a funeral home by displaying facsimiles of the funeral products in a funeral home display area, comprising the steps of:

providing a display case comprising:

a cabinet having interconnected back, top, bottom and side walls;

a door pivoted to a side edge of said cabinet and movable to and between an open position wherein the contents of said cabinet are viewable and a closed position wherein the contents of said cabinet are concealed;

a first sheet-like member removably received against said back wall of said cabinet and including a decorative front, a back and a plurality of apertures therein;

a plurality of facsimiles of funeral home products comprising burial caskets, cremation caskets, cremation containers and cremation urns removably secured to said back of said first sheet-like member, said facsimiles being positioned on said first sheet-like member back so as to be viewable through said apertures when said door is in the open position; and a second sheet-like member which is transparent and which removably overlies said first sheet-like member;

mounting the display case on a wall of the funeral home display area; and opening the door of the display case to display its contents to funeral home customers.

11. A method of offering for sale funeral products to customers of a funeral home by displaying facsimiles of the funeral products in a funeral home display area, comprising the steps of:

providing a display case comprising:

a cabinet having interconnected back, top, bottom and side walls;

a first sheet-like member removably received against said back wall of said cabinet and including a decorative front, a back and a plurality of apertures therein;

a plurality of facsimiles of funeral home products comprising burial caskets, cremation caskets, cremation containers and cremation urns removably secured to said back of said first sheet-like member, said facsimiles being positioned on said first sheet-like member back so as to be viewable through said apertures; and a second sheet like member which is transparent and which removably overlies said first sheet-like member;

mounting the display case on a wall of the funeral home display area; and escorting funeral home customers to the display case to view the contents of the display case.

12. A funeral product display case for displaying facsimiles of funeral products, said display case comprising:

a cabinet having an interior;

a door, having a back side, movably mounted relative to said cabinet, and movable to and between an open position wherein said cabinet interior and said door back side are visible and a closed position wherein said cabinet interior and said door back side are concealed; and a plurality of facsimiles of funeral products removably positioned within said cabinet interior and against said door back side;

further including a first sheet-like member removably received within said cabinet and including a decorative front, a back and a plurality of apertures therein, said facsimiles removably positioned within said cabinet interior being removably secured to said back of said first sheet-like member and viewable through said apertures when said door is in the open position.

13. The funeral product display case of claim 12 further including a second sheet-like member removably received against said back side of said door and including a decorative front, a back and a plurality of apertures therein, said facsimiles removably positioned against said door back side being removably secured to said back side of said second sheet-like member and viewable through said apertures when said door is in the open position.

14. A funeral product display case for displaying facsimiles of funeral products, said display case comprising:

a cabinet having an interior;

a door, having a back side, movably mounted relative to said cabinet, and movable to and between an open position wherein said cabinet interior and said door back side are visible and a closed position wherein said cabinet interior and said door back side are concealed; and a plurality of facsimiles of funeral products removably positioned within said cabinet interior and against said door back side;

further including a sheet-like member removably received against said back side of said door and including a decorative front, a back and a plurality of apertures therein, said facsimiles removably received against said door back side being removably secured to said back side of said sheet-like member and viewable through said apertures when said door is in the open position.

* * * * *